US006192135B1

(12) United States Patent
Monopoli

(10) Patent No.: US 6,192,135 B1
(45) Date of Patent: Feb. 20, 2001

(54) DEARTICULATOR

(76) Inventor: Donald S. Monopoli, 3950 Bristol Ct., Melbourne, FL (US) 32904

( * ) Notice: Under 35 U.S.C. 154(b), the term of this patent shall be extended for 0 days.

(21) Appl. No.: 08/972,278

(22) Filed: Nov. 18, 1997

(51) Int. Cl.[7] ..... H04R 3/00
(52) U.S. Cl. ..... 381/95
(58) Field of Search ..... 381/95, 312, 74, 381/119; 704/272, 270; 455/41

(56) References Cited

U.S. PATENT DOCUMENTS 5,418,778 * 5/1995 Cummiskey et al. ..... 379/406
5,894,523 * 4/1999 Freeman ..... 381/95

* cited by examiner

*Primary Examiner*—Vivian Chang
(74) *Attorney, Agent, or Firm*—Brian S. Steinberger; Law Offices of Brian S. Steinberger

(57) ABSTRACT

An amusement and entertainment system where participants try to continuously speak and/or sing while simultaneously listening to their own voices on a ½ second sound delay. The confusing feedback does not act as a sound enhancement echo but instead causes confusion, disorientation and amusement to the participants and others watching the participants. The system can be used by one or more participants and a third person can switch signals so that one or more participants or others watching can hear the resultant effects of another participant. The system can be table mounted so that participants can be seated about a table. Alternatively, the system can be mounted in a mobile vehicle. Video cameras and monitors can be used to further add to the amusement of participants and others watching the participants. Each headphone can include microphones built into the headbands.

20 Claims, 6 Drawing Sheets

DEARTICULATOR

This invention relates to an entertainment and amusement system, and in particular to a two dimensional audio synchronization interactive system where participants try to continuously speak and sing while listening to their own voice after an approximate ½ second delay time, the effects of which confuse, distort and prevent the participant(s) from continuing to speak and/or sing articulately.

BACKGROUND AND PRIOR ART

Karaoke machines have become very popular for sing-alongs where the purpose is to have the participants follow the lyrics of songs. Technology has been developed to create echo effects for Karaoke machines as well as in public auditoriums. See for example: U.S. Pat. No. 3,681,531 to Burkhard et al.; U.S. Pat. No. 5,442,711 to Toyama; and U.S. Pat. No. 5,444,785 to Izawa et al. However, these devices are used to enhance and magnify the voices of performers such as singers and the like. No confusing feedback of the voices is anticipated nor desired by these devices.

U.S. Pat. No. 4,630,301 to Hohl et al. describes a voice activated echo generator that can be used as a toy and as a speech learning aid for the deaf. However, the application is strictly described for creating echo effects. Similarly, U.S. Pat. No. 5,127,870 to Lin describes a microphone used for generating echoes. None of these patents are intended to have any confusing feedback distortion for entertainment.

Helmets and masks have been proposed for modifying a wearer's voice. See for example, U.S. Pat. No. 4,683,588 to Goldberg and U.S. Pat. No. 4,949,378 to Mammone. However, each of these patents alters the voices by scrambling, camouflaging and disguising the actual voices. U.S. Pat. No. 5,149,104 describes a video game and audio player interaction with real time video synchronization, where player can have their voices modified to reflect video images of objects and animals and the like. For example, the patent mentions an instance where a speaking player has their voice modified to sound like a sheep so that the image of the sheep is emitting animal sounds. None of these patents are intended to have any confusing feedback distortion for entertainment.

SUMMARY OF THE INVENTION

The primary objective of the present invention is to provide an amusement and entertainment system where participants try to speak and/or sing while hearing a constant delayed back feedback of themselves which confuses and prevents the participant from continuing to speak and/or sing.

A preferred embodiment of the entertaining and amusement invention includes at least one microphone receiver for receiving voice signals from at least one participant, a delay means for delaying the voice signals up to approximately ½ second to a transmitter adjacent to the participant for playing the delayed voice signals while the participant in real-time continues to generate the voice signals, wherein the delayed signal does not echo the voice signals, but instead causes confusion and disorientation and eventually stops the participant from continuing to generate the voice signals, all while amusing and entertaining the participant. The transmitter can include an amplified public address speaker, an amplified headphone, or a combination thereof. Multiple microphones for plural participants can include a single mixer connected between the microphones and the delay means. A master of ceremonies can use a three-way switch for switching each of the microphones to the headphones and the loudspeakers. The invention can be built into a table base so that participants can be seated around the table. Another embodiment has the invention built into a mobile vehicle. A camera can be incorporated for taking video images of the participants, and a video monitor can be used for showing the video images to the participant and/or to others. Both the microphone and headphone can be built into one headset with the microphone mounted in the headband of the headset.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
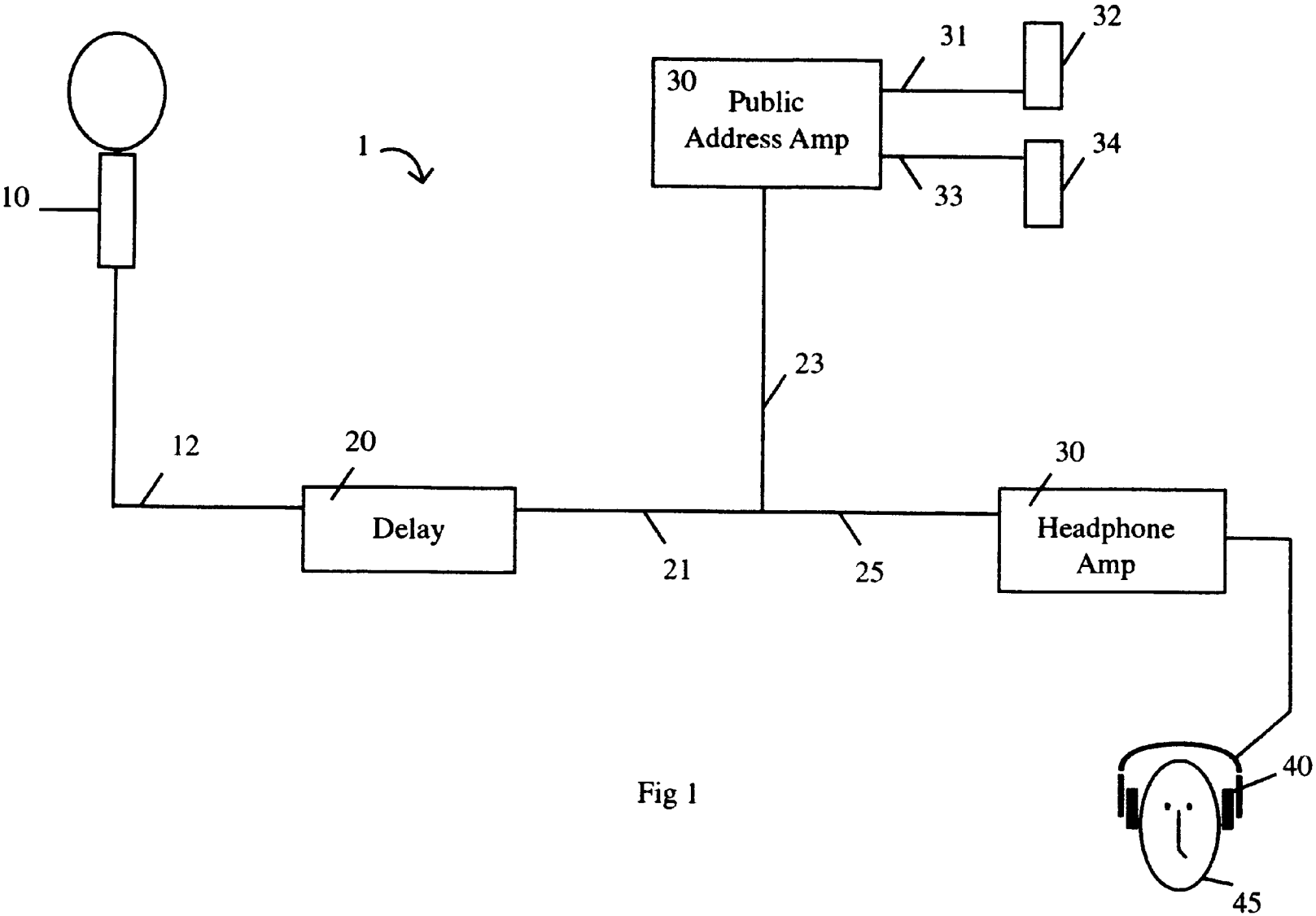
FIG. 1 is a schematic view of a dearticulator invention embodiment with a single input.

FIG. 1 is a schematic view of a dearticulator invention 1 with a single input. Single input 1 includes uni- or omni-directional microphone 10, such as model no. SM-58 by Shure, Radio Shack Omni 33-1070, wire connected 12 to a delay box 20, having an approximate ½ second delay, such as model no. SPX-900 manufactured by Yamaha. From delay 20, the signal 21 splits to output along line 23 to a Public Address PA AMP 30, such as model no. CS 800, manufactured by Peavey, which outputs at 31, 33 to two house speakers 32, 34 such as model no. SP-2manufactured by Peavey. The other split from line 21 goes to line 25 and to the stereo headphone AMP 30, such as model no. MH-40 manufactured by Tascam, and to a headphone 40 such as model no. MDR-V600, manufactured by SONY. In operation, a participant 45 wearing headphones 40 tries to continuously speak and/or sing into microphone 10. The constant approximate ½ second delay in the sound transmission causes confusion when being heard by the user 45, so that user 45 starts to stumble, slur, hesitate and cannot keep concentrating on speaking and/or singing while hearing their own voice on a delay.

Figure 2:
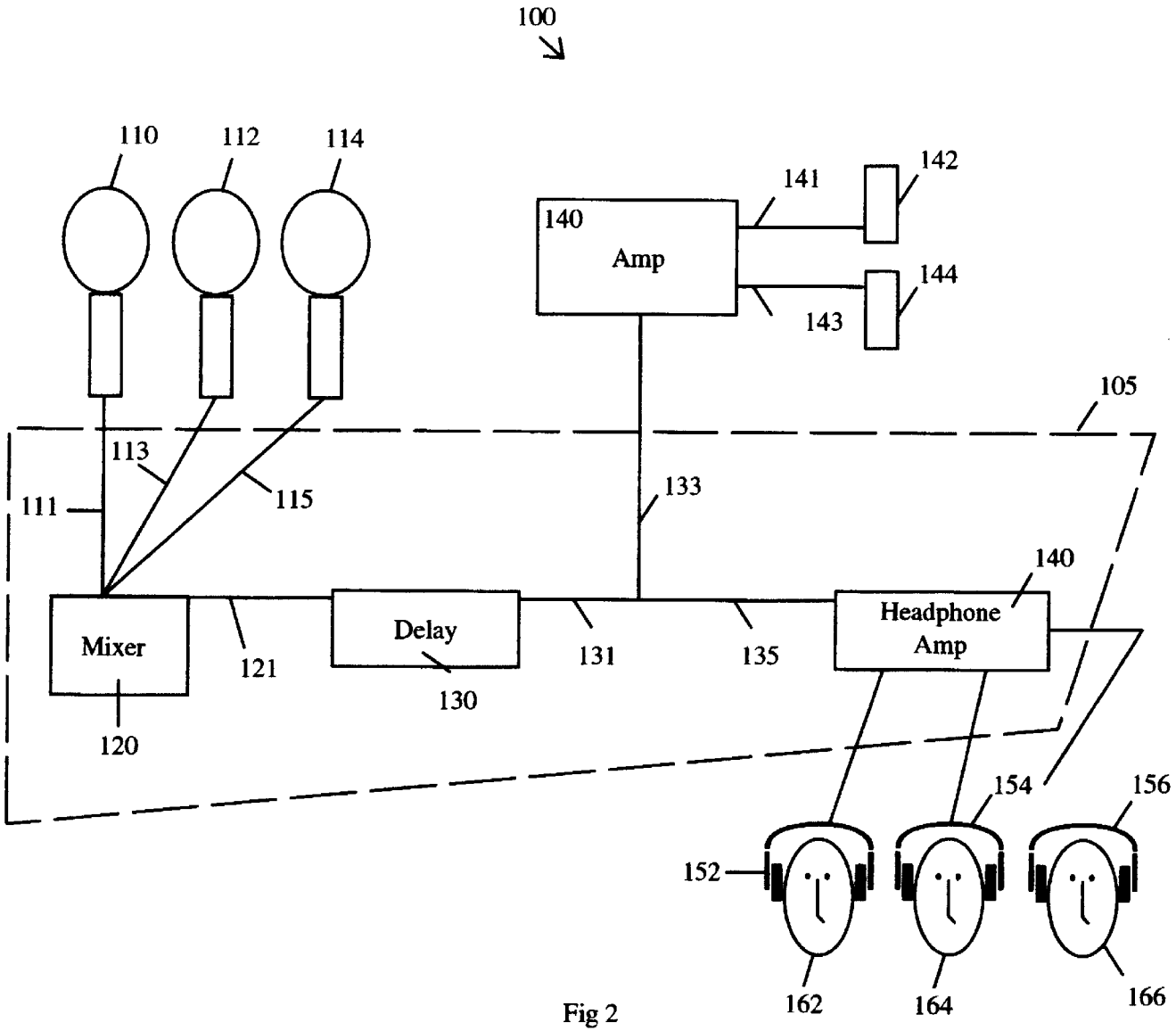
FIG. 2 is a schematic view of the dearticulator embodiment with multiple inputs.

FIG. 2 is a schematic view of another dearticulator 100 with a multiple input. Multiple input device 100 includes omni-directional microphones 110, 112, 114 such as model no. SM-58 by Shure, Radio Shack Omni 33-1070, wire connected 111, 113, 115 to a microphone mixer 120, such as model no. 32-1214 manufactured by Radio Shack. Stereo line 121 connects to delay box 130, having an approximate ½ second delay, such as model no. SPX-900 manufactured by Yamaha. From delay 130, the signal 131 splits to output along line 133 to a Public Address PA AMP 140, such as model no. CS 800, manufactured by Peavey, which outputs at 141, 143 to two house speakers 142, 144 such as model no. SP-2 manufactured by Peavey. The other split from line 131 goes to line 135 and to the stereo headphone AMP 140, such as model no. MH-40manufactured by Tascam, and to headphones 152, 154, 156 such as model no. MDR-V600, manufactured by SONY. In operation, participants 162, 164, 166 wearing respective headphones 152, 154, 156 each try to continuously speak and/or sing into microphones 110, 112, and 114, respectively. The constant approximate ½ second delay while speaking/singing causes confusion when being heard so that each of the participants eventually stumble, slur, hesitate and cannot keep concentrating on speaking/singing while hearing their own voice on a delay.

Figure 3:
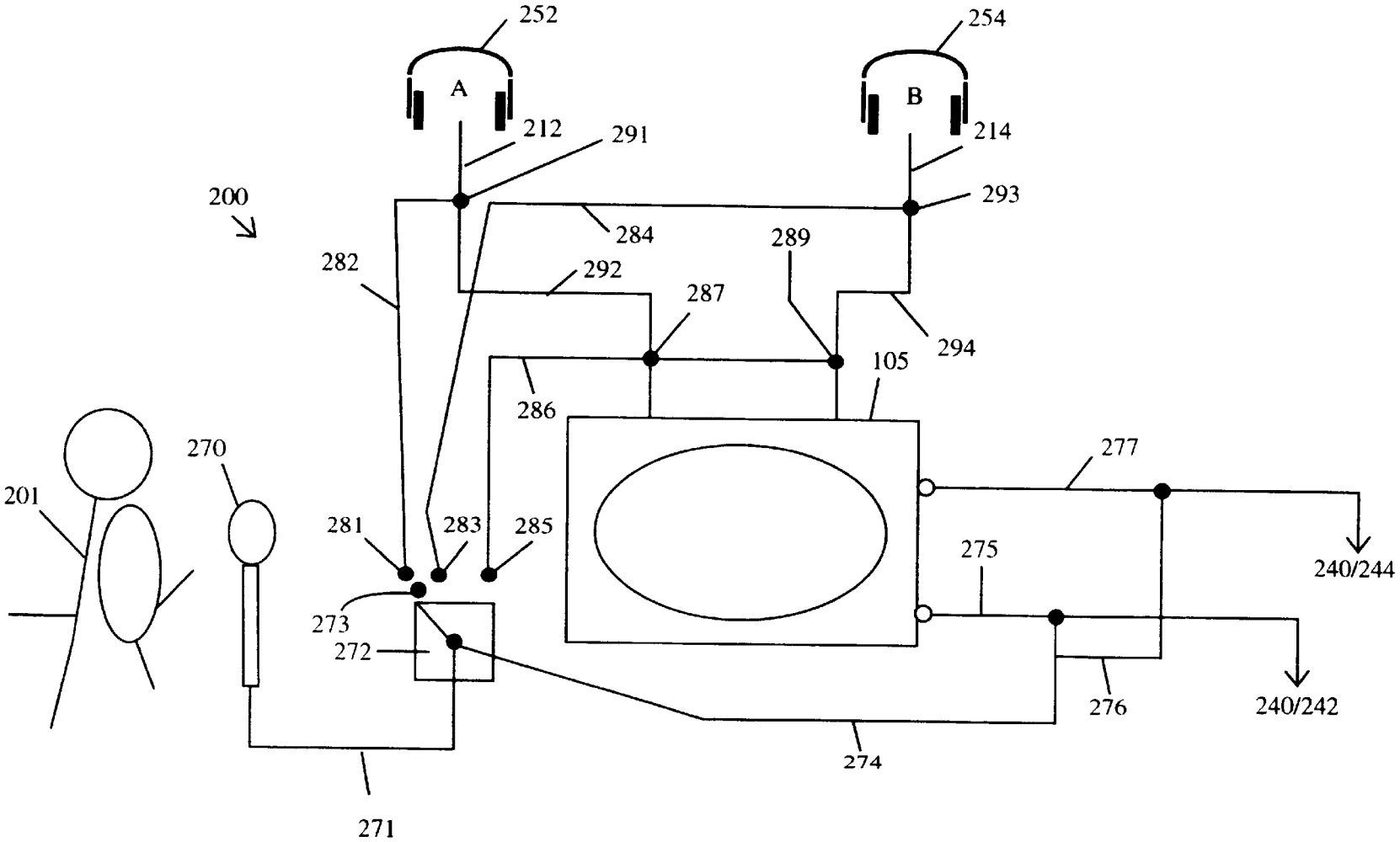
FIG. 3 is a schematic view of the multiple input dearticulator of FIG. 2 using a Master of Ceremonies(MC) embodiment.

FIG. 3 is a schematic view 200 of the multiple input dearticulator of FIG. 2 using a Master of Ceremonies(MC). An MC 201 using a separate microphone 270 connected to an external box 272 that can plug into the dearticulator unit, has a three-way control switch 273. First switch 281 connects by line 282 to node 291 allowing participant A to speak/sing and/or listen 252 by stereo or mono line 212 which connects by line 292 to dearticulator 105. The latter housing mixer 120, delay 130 and headphone AMP 130 shown and described in reference to FIG. 2. Moving switch 273 to second switch 283 connects to line 284 to node 293 allowing participant B to speak/sing and/or listen 254 by line 214 which connects by line 294 to dearticulator 105. Third switch position 285 connects line 286 to both nodes 287 and 289 allowing both participants A and B to speak/sing and/or listen. Three-way switch 272 connects by line 274 and 276 to unit outputs 277, 275, which in turn output to amplifiers 240 and loudspeakers 242, 244, similar to those described in reference to FIG. 2. The MC application 200 can allow an MC 201 to direct and ask questions between two or more people A, B, such as in a politicians debate, board meeting, radio/television interviews, parties, bars, social gatherings such as weddings, and the like.

Figure 4:
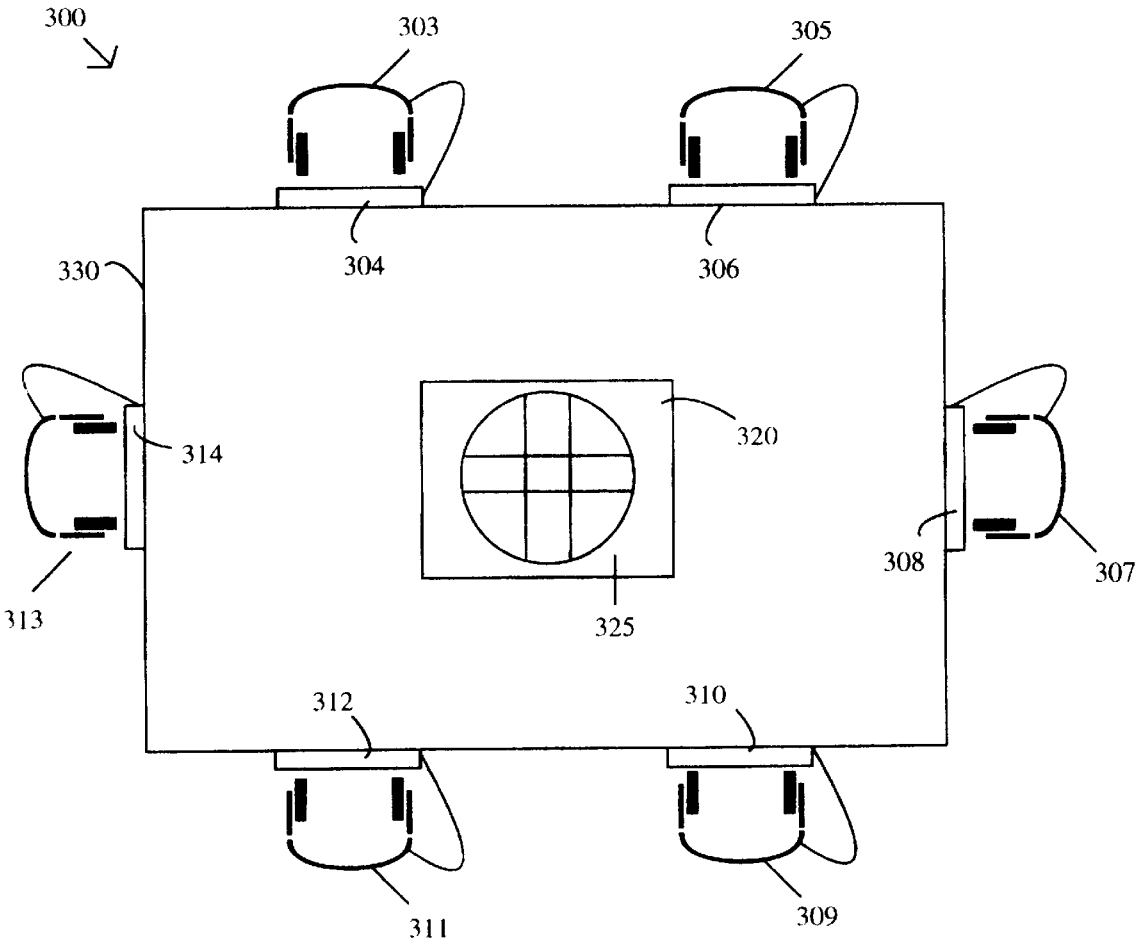
FIG. 4 is a perspective view of using the multiple input dearticulator of FIG. 2 with a single microphone embodiment.

FIG. 4 is a perspective view 300 of using the multiple input dearticulator 100 of FIG. 2 using a table 330 with a single omni-directional microphone 320, where individual participants siting about the table 330 can each plug their respective headphones 303, 305, 307, 309, 311, 313 into respective plug input consoles 304, 306, 308, 310, 312, 314. Table 330 can include components 120, 130, and 140 shown in FIG. 2. While table 330 is shown as being rectangular, the tables used can be of other shapes such as but not limited to square, circular, semi-circular and the like, and be made from different materials such as but not limited to plastic, wood, and the like. The table dearticulator embodiment 300 can be used in both commercial and residential settings. An MC 201 shown in FIG. 3 can also be incorporated to direct the participants with questions, songs and the like.

Figure 5A:
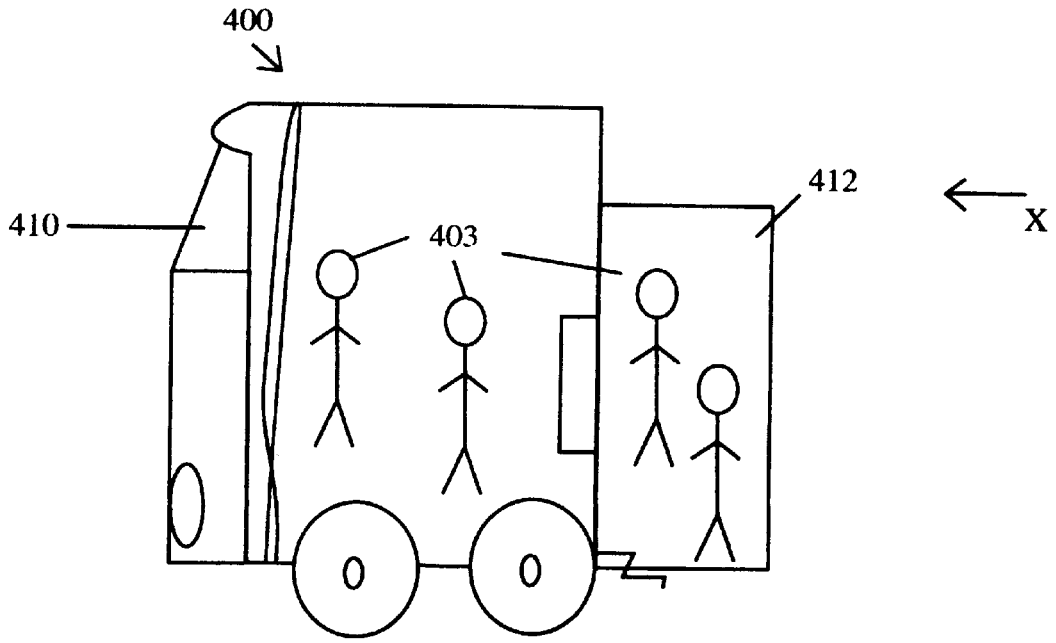
FIG. 5A is a perspective view of the multiple input dearticulator of FIG. 2 in a mobile vehicle embodiment.
Figure 5B:
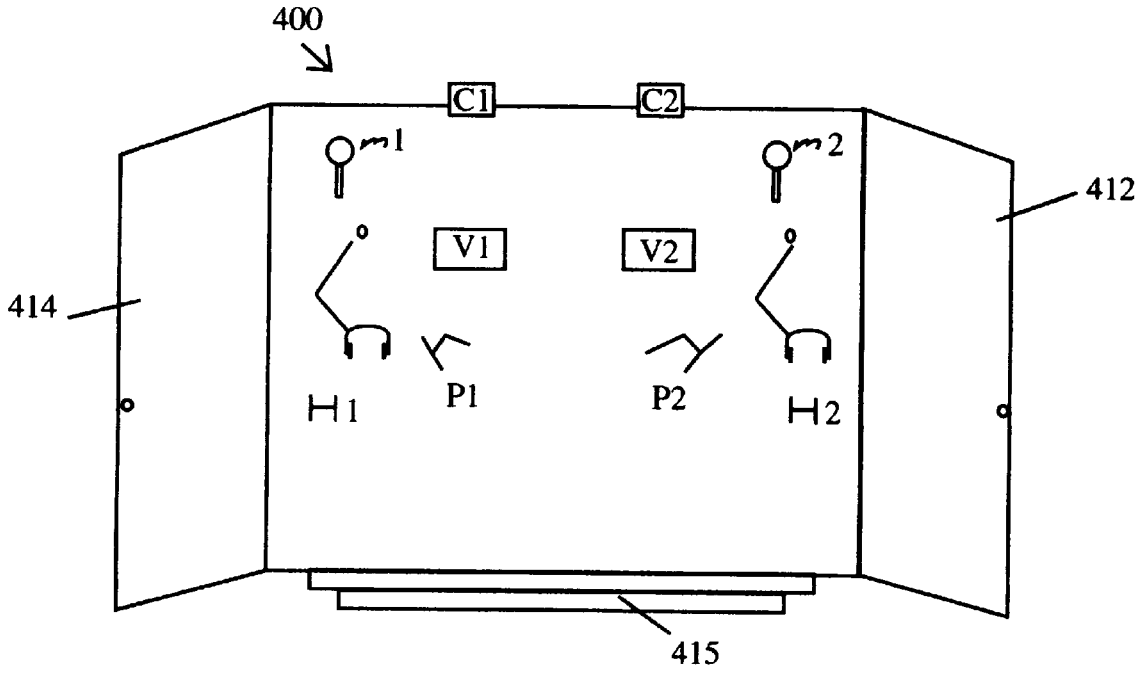
FIG. 5B is a side view of the mobile dearticulator embodiment of FIG. 5A along arrow X.

FIG. 5A is a perspective view of the multiple input dearticulator of FIG. 2 in a mobile vehicle embodiment 400. FIG. 5B is a side (rear) view of the mobile dearticulator embodiment 400 of FIG. 5A along arrow X. Referring to FIGS. 5A–5B, mobile vehicle embodiment 400 includes a mobile vehicle 410 such as a van, truck with entry way doors 412, 414, so that participants 403 can enter inside of the vehicle 410. Inside vehicle 410, seats P1, P2, headphones H1, H2, and microphones m1, m2 can be used for the participants 403, using the schematic circuitry described in reference to the previous figures. Furthermore, camcorder type cameras C1, C2, connected to video monitors V1, V2 so that participant P1, can view through monitor V1, the video image of participant P2. And participant P2, can likewise view through monitor V2, the video image of participant P1. Mobile vehicle embodiment 400 can be used at various sites such as but not limited to fairs, carnivals, festivals. The outside of the van can have one way mirrors so that vehicle occupants cannot look out but a passerby can look in to see the participants laughing but not knowing why they are laughing.

Figure 6:
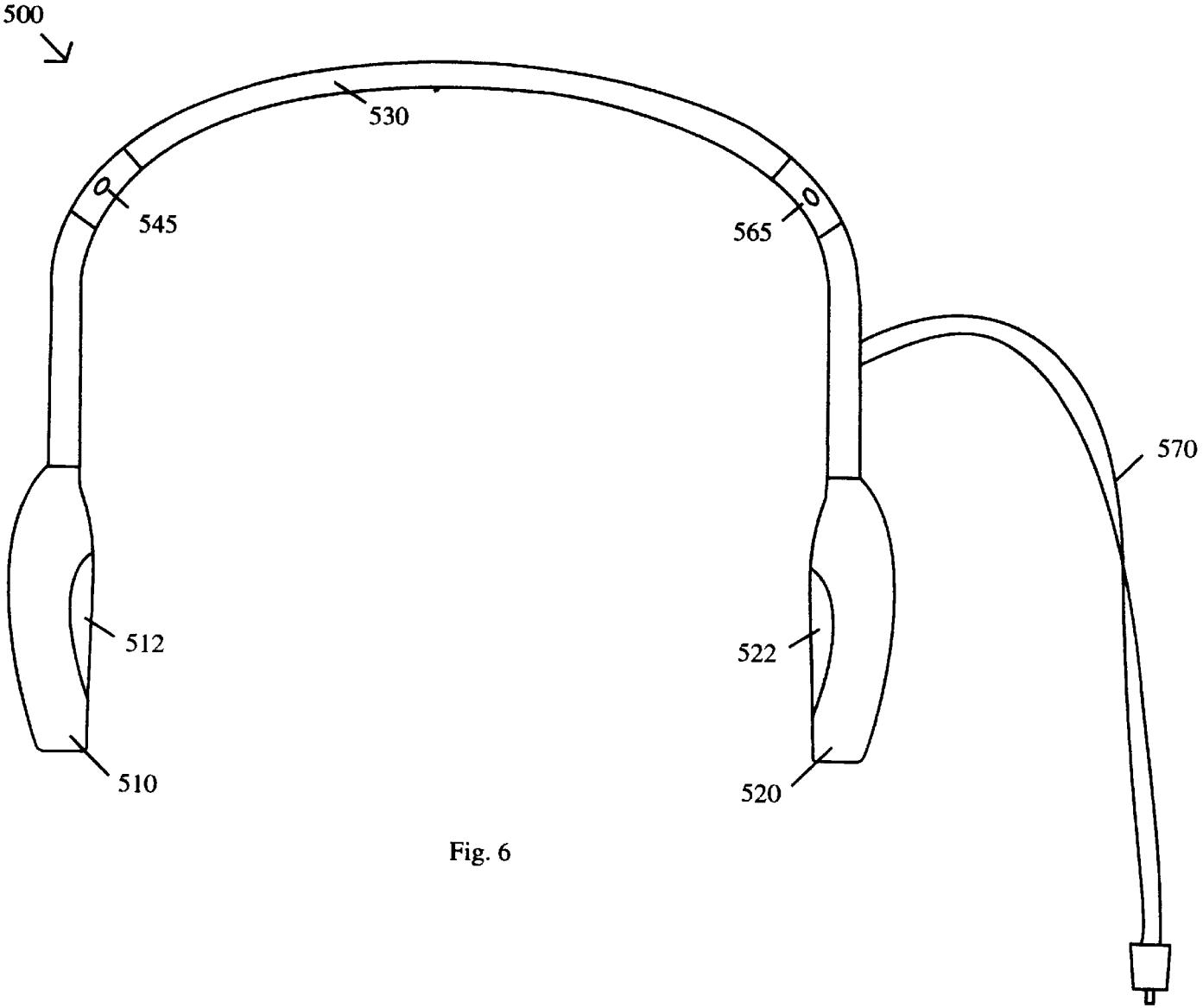
FIG. 6 is a perspective view of a dearticulator headphone embodiment for use with the preceding figures.

FIG. 6 is a perspective view 500 of a dearticulator headphone embodiment for use with the preceding figures. Headphone 500 includes ear cup portions 510, 520, with respective speakers 512, 522 with curved headband 530 there between. Two built-in microphones 545, 565, such as those previously described, can be mounted within the curved band 530 on opposite sides of the band 530 adjacent to ear cups 510, 520. A plug-in line 570 can be connected to the speakers 512, 522 and microphones 545, 565, to the components depicted in the preceding figures.

Although not depicted, the embodiments can be used in a coin operated system.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An apparatus for entertaining and amusing participants by delaying feedback of their voices in order to confuse the participants, without echo enhancement, comprising in combination:

a receiver for receiving voice signals from a participant;

a delay means for delaying the voice signals greater than a 1/10 of a second; and a transmitter adjacent to the participant for playing the delayed voice signals while the participant in real-time continues to generate the voice signals, wherein the delayed signal does not echo the voice signals, but instead causes confusion and disorientation, and eventually stops the participant from continuing to generate the voice signals, while amusing and entertaining the participant.

2. The apparatus of claim 1, wherein the receiver includes:

a microphone.

3. The apparatus of claim 1, wherein the delay means includes:

a delay of approximately ½ second.

4. The apparatus of claim 1, wherein the transmitter includes:

a speaker.

5. The apparatus of claim 4, wherein the transmitter further includes:

an amplifier connected between the delay means and the speaker.

6. The apparatus of claim 1, wherein the transmitter includes:

a headphone.

7. The apparatus of claim 6, wherein the transmitter includes:

an amplifier connected between the delay means and the headphone.

8. The apparatus of claim 2, wherein the receiver includes:

a mixer connected between the microphone and the delay means.

9. The apparatus of claim 1, wherein the transmitter includes:

a headphone; and a speaker.

10. The apparatus of claim 9, further including:

a first amplifier connected between the delay means and the headphone; and a second amplifier connected between the delay means and the speaker.

11. The apparatus of claim 10, wherein the receiver includes:

a microphone; and a mixer connected between the microphone and the delay means.

12. The apparatus of claim 2, wherein the receiver includes:

a second microphone.

13. The apparatus of claim 12, further comprising:

a switch means for switching the transmitter connecting between the first microphone and the second microphone.

14. The apparatus of claim 1, further comprising:

a table base connected to the receiver and the transmitter.

15. The apparatus of claim 1, further comprising:

a mobile vehicle for housing the transmitter and the receiver.

16. The apparatus of claim 15, wherein the vehicle further includes:

a camera for taking video images of the participant; and a video monitor for showing the video images.

17. The apparatus of claim 1, wherein the receiver and the transmitter includes:

a headset having at least one speaker for covering an ear of the participant; and a microphone attached to the headset.

18. The apparatus of claim 17, wherein the microphone further includes:

a support mount in a headband of the headset.

19. An entertainment and amusement device, comprising:

a microphone for receiving audible voice emissions from a participant, and for generating a signal corresponding to the audible voice emissions;

a delay means for receiving the signal and causing a pre-selected delay in the signal;

a speaker connected to the delay means for passing the delayed signal back to the participant while the participant in real-time continues to generate the audible voice emissions, wherein the delayed signal does echo the audible voice emissions, and the participant hears their voice in a delayed version that causes confusion and disorientation to the participant.

20. The entertainment and amusement device of claim 19, wherein the microphone and the speaker are mounted in a headset.

* * * * *

UNITED STATES PATENT AND TRADEMARK OFFICE

CERTIFICATE OF CORRECTION

PATENT NO. : 6,192,135 B1
DATED : February 20, 2001
INVENTOR(S) : Monopoli

It is certified that error appears in the above-identified patent and that said Letters Patent is hereby corrected as shown below:

Title page,
Item [56], References Cited, please add the following references

| | | | | |
|---|---|---|---|---|
| -- 3,681,531 | 08/01/72 | Burkhard | 179 | IJ |
| 4,400,591 | 08/23/83 | Jennings | 179 | 156 |
| 4,630,301 | 12/16/86 | Hohl | 381 | 36 |
| 4,683,588 | 07/28/87 | Goldberg | 381 | 61 |
| 4,949,378 | 08/14/90 | Mammone | 380 | 9 |
| 5,127,870 | 07/07/92 | Lin | 446 | 416 |
| 5,149,104 | 09/22/92 | Edelstein | 273 | 434 |
| 5,442,711 | 08/15/95 | Toyama | 381 | 63 |
| 5,444,785 | 08/22/95 | Izawa | 381 | 63 |
| 5,559,792 | 09/24/96 | Bottoms | 370 | 20 -- |

Signed and Sealed this

Twenty-third Day of April, 2002

*Attest:*

*Attesting Officer*

JAMES E. ROGAN
*Director of the United States Patent and Trademark Office*